US011114214B2

(12) United States Patent
Hermans

(10) Patent No.: US 11,114,214 B2
(45) Date of Patent: Sep. 7, 2021

(54) ALUMINIUM CONDUCTORS

(71) Applicant: LAMIFIL N.V., Hemiksem (BE)

(72) Inventor: Peter Hermans, Ostend (BE)

(73) Assignee: LAMIFIL, N.V., Hemiksem (BE)

( * ) Notice: Subject to any disclaimer, the term of this patent is extended or adjusted under 35 U.S.C. 154(b) by 240 days.

(21) Appl. No.: 16/094,572

(22) PCT Filed: Apr. 18, 2017

(86) PCT No.: PCT/IB2017/052207
§ 371 (c)(1),
(2) Date: Oct. 18, 2018

(87) PCT Pub. No.: WO2017/182943
PCT Pub. Date: Oct. 26, 2017

(65) Prior Publication Data

US 2019/0108926 A1 Apr. 11, 2019

(30) Foreign Application Priority Data

Apr. 18, 2016 (BE) ..... 2016/5266

(51) Int. Cl.

| | |
|---|---|
| ***H01B 1/02*** | (2006.01) |
| ***H01B 13/00*** | (2006.01) |
| ***C22F 1/04*** | (2006.01) |
| ***C22C 21/00*** | (2006.01) |

(52) U.S. Cl.
CPC ..... *H01B 1/023* (2013.01); *C22C 21/00* (2013.01); *C22F 1/04* (2013.01); *H01B 13/0016* (2013.01); *H01B 13/0036* (2013.01)

(58) Field of Classification Search
CPC ..... H01B 1/023
See application file for complete search history.

(56) References Cited

U.S. PATENT DOCUMENTS

| | | | | |
|---|---|---|---|---|
| 4,121,951 A | | 10/1978 | Fortin et al. | |
| 4,182,640 A | * | 1/1980 | Yokota | C22C 21/12 148/438 |
| 5,243,137 A | * | 9/1993 | Gentry | H01B 5/104 156/50 |

(Continued)

FOREIGN PATENT DOCUMENTS

| | | |
|---|---|---|
| CL | 30372 | 8/1977 |
| CN | 102978466 B | 8/2015 |
| WO | 0244432 A1 | 6/2002 |

OTHER PUBLICATIONS

Office Action from corresponding Chilean Application No. 201802954, dated Jul. 8, 2019, 7 Pages.

(Continued)

*Primary Examiner* — Hoa C Nguyen
*Assistant Examiner* — Amol H Patel
(74) *Attorney, Agent, or Firm* — Workman Nydegger

(57) ABSTRACT

A conductor is suitable for use in a high-voltage cable, and includes an aluminium alloy, in which the aluminium alloy comprises one or more of a group 3, 4 or 5 element and/or a lanthanide, each with a concentration in the range of 0.006 to 0.03% (m/m). The conductor has undergone a thermal treatment at a temperature from the range of 185° C. to 315° C. during a period from the range of 12 hours to 24 hours, so that the conductor has a conductivity of 61% IACS or more.

14 Claims, 1 Drawing Sheet

(56) References Cited

U.S. PATENT DOCUMENTS

Figure 1A:
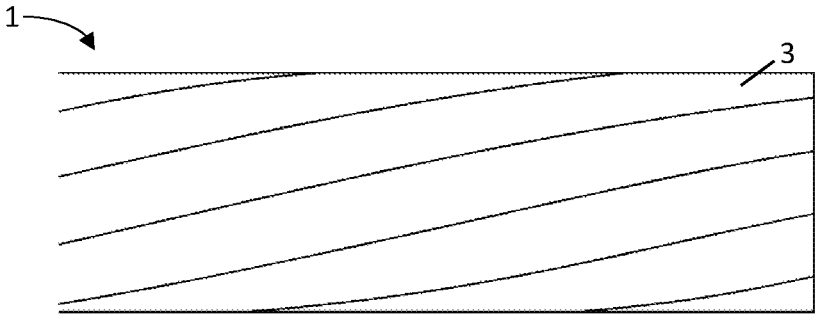

| | | | | |
|---|---|---|---|---|
| 2002/0162607 | A1* | 11/2002 | Chadwick | C22C 21/00 148/415 |
| 2005/0005433 | A1* | 1/2005 | Elder | H01B 13/0285 29/825 |
| 2015/0132182 | A1 | 5/2015 | Comoret | |

OTHER PUBLICATIONS

Belgian Search Report from BE Application No. BE 201605266, dated Dec. 8, 2016.
International Search Report from PCT Application No. PCT/IB2017/052207, dated Jul. 14, 2017.
"Thermal-Resistant Aluminium Alloy Wire for Overhead Line Conductor," International Standard IEC 62004, First Edition, Feb. 2007, 14 Pages.
Office Action from corresponding EP Application No. 17724108, dated Jul. 8, 2020.

* cited by examiner

ALUMINIUM CONDUCTORS

SCOPE OF THE INVENTION

This invention generally relates to conductors and in particular to conductors based on an aluminium alloy, suitable for use in high-voltage cables.

BACKGROUND OF THE INVENTION

Aluminium offers a higher conductivity per mass than copper and is therefore a common choice in electrical conductors for a diversity of applications, for example in high-voltage cables. Depending on the applications, cables may be made purely based on aluminium conductors (e.g. AAC or AAAC), or as a combination of aluminium conductors around a diversity of cores, such as around a steel (e.g. ACSR, ACSS), carbon fibre composite (e.g. ACCS), aluminium oxide fibre composite (e.g. ACCR) or invar (e.g. TACIR) core.

Aluminium conductors composite core (ACCS), in which the conductors consist of soft pure aluminium, currently offer an interesting combination of characteristics in the form of a light cable with high conductivity and low thermal expansion. The low thermal expansion in turn allows for a higher operating temperature; combined with the increased conductivity, a considerable increase in capacity of the cable may be achieved as a result. Nonetheless, the composite core is rather elastic, so that the cable easily deflects under load. This cable is therefore not very suitable for use in areas where wind or ice formation are relatively common and considerable.

Also known are aluminium conductors steel reinforced (ACSR), in which the conductors consist of hard pure aluminium. These offer a considerably higher tensile strength and are therefore better resistant to load; the conductivity, on the contrary, is lower than for soft pure aluminium and the thermal resistance is considerably restricted, so that these cables have a lower capacity.

Furthermore, aluminium alloys are known too which for example lead to conductors with an improved thermal resistance, at the expense of a reduction in the conductivity. For example, hard aluminium/zirconium alloys are known with, typically, a similar tensile strength as hard pure aluminium and a high thermal resistance comparable with or higher than soft pure aluminium. On the contrary, these possess a conductivity that is lower than both pure forms. Specific combinations of these characteristics are laid down in the IEC62004 version 2007 standard for aluminium/zirconium alloys (more specifically alloys AT1 and AT3 of this standard).

There is room for conductors based on aluminium alloys which provide various desirable characteristics, without detracting from the characteristics that are also achieved by conductors based on annealed or non-annealed pure aluminium.

SUMMARY OF THE INVENTION

It is an objective of embodiments of the present invention to provide better conductors based on aluminium alloys.

It is an advantage of embodiments of the present invention that conductors are provided based on specific aluminium alloys, which have better characteristics than conductors that are made with annealed or non-annealed pure aluminium.

It is an advantage of embodiments according to the present invention that an aluminium conductor with a higher tensile strength may be achieved, without sacrificing the conductivity or the thermal resistance, compared with soft pure aluminium.

It is an advantage of embodiments according to the present invention that an aluminium conductor with a higher conductivity and higher thermal resistance may be obtained, without sacrificing the tensile strength, compared with hard pure aluminium.

It is an advantage of embodiments according to the present invention that an aluminium conductor with an even higher thermal resistance may be obtained, without sacrificing the conductivity or tensile strength, compared with hard pure aluminium.

It is an advantage of embodiments of the present invention that the alloys AT1 and AT3 from the IEC62004 version 2007 standard may be achieved or that improvements may even be obtained compared with the standard.

It is an advantage of embodiments of the present invention that soft or hard conductors may be obtained which may be combined with a diversity of cores and may therefore offer an improvement for various existing cable types.

The above-mentioned objective is achieved by conductors, high-voltage cables, aluminium alloys, and/or a use according to the present invention.

In a first aspect, the present invention relates to a conductor suitable for use in a high-voltage cable. The conductor comprises an aluminium alloy, in which the aluminium alloy comprises one or more of a group 3, 4 or 5 element and/or a lanthanide, each with a concentration in the range of 0.006 to 0.03% (m/m), preferably in a range of 0.006 to 0.027% (m/m) such as for example in the range of 0.008 to 0.025% (m/m), and in which the conductor has undergone a thermal treatment at a temperature from the range of 185° C. to 315° C. during a period from the range of 12 hours to 24 hours, so that the conductor has a conductivity of 61% IACS or more. In some embodiments, the alloy may therefore include several group 3, 4 or 5 elements.

It is an advantage of embodiments of the present invention that conductors with the composition indicated and where the thermal treatment indicated has been carried out on the conductor, i.e. on the drawn conductor with its final diameter, have a unique combination of conductivity, tensile strength, and thermal resistance.

It is an advantage of embodiments of the present invention that conductors are obtained with an IACS of 61% or more. It is important to note here that the conductivity is therefore as good as that of pure drawn aluminium, whereas the tensile strengths are at least identical to those of aluminium. The present invention therefore also relates to embodiments that have an equally good or even better conductivity as well as an equally good tensile strength as pure drawn aluminium conductors, i.e. without alloy elements.

It is an advantage of embodiments of the present invention that in addition to the good conductivity and good tensile strength, a good thermal resistance is obtained for the conductors too. The thermal resistance is thereby defined via the standard IEC62004.

It is an advantage of some embodiments of the present invention that the stretch of the final drawn conductor may be higher than 2.5%, for example more than 2.75% or for example more than 3% for hard conductors and higher than 8%, for example higher than 15% for soft conductors.

In some embodiments, the total concentration of alloy elements may be restricted to 0.04% (m/m).

In embodiments, the aluminium alloy may comprise 99.5% (m/m) or more aluminium, preferably 99.65% (m/m) or more.

In embodiments, the aluminium alloy may furthermore also comprise 0.00 to 0.02% (m/m) yttrium and/or erbium, preferably 0.01% (m/m).

In embodiments, the aluminium alloy may furthermore also comprise 0.1 to 0.3% (m/m) iron, preferably 0.12 to 0.18% (m/m).

In embodiments, the thermal treatment may comprise a treatment at a temperature of 185 to 315° C. for 12 to 24 hours.

In embodiments, the group 3 elements may be scandium or yttrium or a combination thereof, the group 4 elements may be titanium, zirconium or hafnium or a combination thereof, the group 5 elements may be niobium or tantalum or a combination thereof, and the lanthanide may be lanthanum, cerium praseodymium or erbium or a combination thereof.

In embodiments, the aluminium alloy may comprise 0.008 to 0.010% (m/m) zirconium, and the thermal treatment may comprise a treatment at a temperature of 270 to 290° C. for 12 to 24 hours.

In embodiments, the aluminium alloy may comprise 0.013 to 0.020% (m/m) zirconium, and the thermal treatment may comprise a treatment at a temperature of 185 to 225° C. for 12 to 24 hours.

In embodiments, the aluminium alloy may comprise 0.020 to 0.025% (m/m) zirconium, and the thermal treatment may comprise a treatment at a temperature of 200 to 240° C. for 12 to 24 hours.

In a second aspect, the present invention relates to a use of the conductor from the first aspect in a high-voltage cable.

In a third aspect, the present invention relates to a high-voltage cable comprising a core and one or several conductors according to the first aspect.

The high-voltage cable may be a high-voltage cable suitable for an overhead line.

In embodiments, the core may comprise composite, steel, or invar.

In embodiments, the core may comprise composite or steel or invar, the aluminium alloy may comprise 0.008 to 0.010% (m/m) zirconium, and the thermal treatment may comprise a treatment at a temperature of 270 to 290° C. for 12 to 24 hours.

In embodiments, the core may comprise composite or steel or invar, the aluminium alloy may comprise 0.013 to 0.020% (m/m) zirconium, and the thermal treatment may comprise a treatment at a temperature of 185 to 225° C. for 12 to 24 hours.

In embodiments, the core may comprise composite or steel or invar, the aluminium alloy may comprise 0.020 to 0.025% (m/m) zirconium, and the thermal treatment may comprise a treatment at a temperature of 200 to 240° C. for 12 to 24 hours.

In a fourth aspect, the present invention relates to an aluminium allow suitable for use in the conductor according to the first aspect. The aluminium alloy comprises one or several of a group 3, 4 or 5 element and/or a lanthanide, each with a concentration in the range of 0.006 to 0.03% (m/m), preferably in a range of 0.006 to 0.027% (m/m) such as for example in the range of 0.008 to 0.025% (m/m).

In embodiments, the aluminium alloy may comprise 99.5% (m/m) or more aluminium, preferably 99.65% (m/m) or more.

In embodiments, the aluminium alloy may comprise 0.00 to 0.02% (m/m) yttrium or erbium, preferably 0.01% (m/m).

In embodiments, the aluminium alloy may furthermore also comprise 0.1 to 0.3% (m/m) iron, preferably 0.12 to 0.18% (m/m).

In embodiments, the aluminium alloy may be fully annealed.

In embodiments, the group 3 elements may be scandium or yttrium or a combination thereof, the group 4 elements may be titanium, zirconium or hafnium or a combination thereof, the group 5 elements may be niobium or tantalum or a combination thereof, and the lanthanide may be lanthanum, cerium, praseodymium or erbium or a combination thereof.

In a fifth aspect, the present invention relates to a use of the aluminium alloys according to the fourth aspect in the conductor according to the first aspect.

In yet another aspect, the present invention relates to a method for the production of a conductor suitable for use in a high-voltage cable according to the aspect described above, the method including melting of technically pure aluminium in a melting furnace, alloying of the alloy elements, continuously casting of a profile and in-line rolling of the profile within a temperature range of 380° C. to 540° C., drawing of a conductor from a wire rod to the end diameter, and thermally treating of the wires with end diameter.

Specific and preferable aspects of the invention have been included in the attached independent and dependent claims. Features of the dependent claims may be combined with features of the independent claims and with features of other dependent claims such as indicated and not only as expressly brought forward in the claims.

These and other aspects of the invention will be apparent from and be clarified by reference to the embodiment(s) described below.

SHORT DESCRIPTION OF THE FIGURES

Figure 1B:
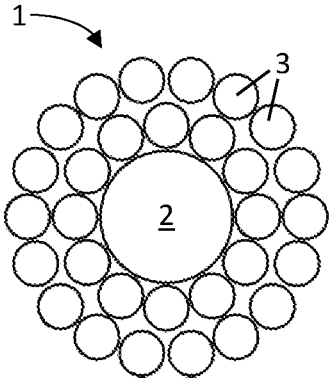
Figure 1C:
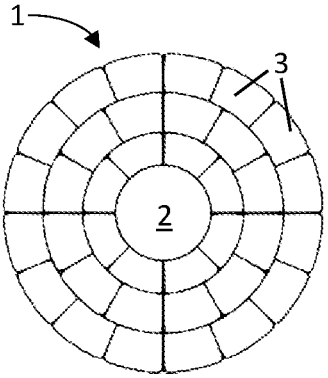

FIGS. 1(*a*) to 1(*c*) illustrate a side view of a cable according to an embodiment of the present invention, as well as a cross section of a cable according to various embodiments of the present compound.

The figures are only schematic and not restrictive. It is possible that the dimensions of some components have been exaggerated and have not been represented to scale in the figures for illustrative purposes.

Reference numbers used in the claims cannot be interpreted to restrict the scope of protection. In the various figures, the same reference numbers refer to the same or similar elements.

DETAILED DESCRIPTION OF ILLUSTRATIVE EMBODIMENTS

The present invention will be described in respect of special embodiments and with reference to certain drawings, however the invention will not be restricted to this but will only be restricted by the claims. The drawings described are only schematic and not restrictive. In the drawings, the dimensions of some elements may have been enlarged and not have been drawn to scale for illustrative purposes. The dimensions and the relative dimensions sometimes do not correspond with the up-to-date practical embodiment of the invention.

Furthermore, the terms first, second, third and the like in the description and in the claims are used to distinguish similar elements and are not necessarily used for describing an order, nor in time, nor in space, nor in ranking nor in any other manner. It should be understood that the terms used in this way are interchangeable in appropriate circumstances and that the embodiments of the invention described herein are suitable to work in a different order than described or indicated here.

Furthermore, the terms top, bottom, above, in front of and the like used in the description and the claims are used for description purposes and not necessarily to describe relative positions. It should be understood that the terms used as such are interchangeable in given circumstances and that the embodiments of the invention described herein are also suitable for functioning according to different orientations than described or indicated here.

It should be noted that the term "comprises", as used in the claims, should not be interpreted as being restricted to the items described thereafter; this term does not exclude any other elements or steps. It may be interpreted as specifying the presence of the features, values, steps, or components indicated which are referred to but does not exclude the presence or addition of one or several other features, values, steps or components, or groups thereof. So, the extent of the expression "a device comprising items A and B" should not be restricted to devices consisting of components A and B only. It means that in respect of the present invention, A and B are the only relevant components of the device.

Reference throughout this specification to "one embodiment" or "an embodiment" means that a specific feature, structure, or characteristic described in connection with the embodiment has been included in at least one embodiment of the present invention. So, the occurrence of the expressions "in one embodiment" or "in an embodiment" in various locations throughout this specification do not necessarily need to refer to the same embodiment all the time, but can do so. Furthermore, the specific features, structures or characteristics may be combined in any suitable manner as would be clear to a person skilled in the art on the basis of this publication, in one or several embodiments.

Similarly, it should be appreciated that in the description of sample embodiments of the invention, various features of the invention are sometimes grouped together in one single embodiment, figure or description thereof intended to streamline the publication and to help the understanding of one or several of the various inventive aspects. This method of publication should therefore not be interpreted as a reflection of an intention that the invention requires more features than explicitly mentioned in each claim. Rather, as the following claims reflect, inventive aspects lie in fewer than all features of one single previously publicised embodiment. So, the claims following on from the detailed description have been explicitly included in this detailed description, with every independent claim being a separate embodiment of the invention.

Furthermore, while some embodiments described herein comprise some, but not other, features included in other embodiments, combinations of features from various embodiments are intended to be within the scope of the invention, and form these various embodiments as would be understood by the person skilled in the art. For example, in the following claims, any of the embodiments described may be used in any combination.

In the description provided here, a large number of specific details are raised. It may therefore be understood that embodiments of the invention may be embodied without these specific details. In other cases, well-known methods, structures, and techniques are not shown in detail in order to keep this description clear.

Such as used herein, the international annealed copper standard (IACS) is a unit for electrical conductivity, relatively compared with an annealed copper conductor standard. A conductivity of 100% IACS thereby corresponds with $5.80\times10^7$ siemens per metre at 20° C.

Such as used herein, the thermal resistance, tensile strength and conductivity are characteristics of an aluminium conductor, which may be obtained as described in the IEC62004 standards.

Such as used herein, a soft aluminium conductor is an aluminium conductor in an annealed state. This means that the thermal treatment has been executed such that the stretch in the conductor is high, such as more than 15%, for example more than 20% and even more than 40%. A soft aluminium conductor typically has a low tensile strength, for example 100 MPa or less, and a high conductivity, such as more than 61%, for example more than 61.5% or even up to 63%. Such as used herein, a hard aluminium conductor is an aluminium conductor which is not in an annealed state.

Such as used herein, the ratios in composition for a conductor are always expressed in weight percentages % (m/m).

Such as used herein, group 3, 4 or 5 elements mean those elements from group 3, group 4, or group 5 according to Mendeljev's table.

Such as used herein, a conductor means a single wire. The stranding of conductors, around a core or not, results in a bare cable. Such cables may for example be used as high-voltage cables.

In a first aspect, the present invention relates to a conductor suitable for use in a high-voltage cable. The conductor comprises an aluminium alloy, in which the aluminium alloy comprises one or more of a group 3, 4 or 5 element and/or a lanthanide, each with a concentration in the range of 0.006 to 0.03% (m/m), preferably in a range of 0.006 to 0.027% (m/m) such as for example in the range of 0.008 to 0.025% (m/m), and in which the conductor has undergone a thermal treatment, so that the conductor has a conductivity of 61% IACS or more. Within the present invention, it was found surprising that, after an appropriate thermal treatment, an aluminium conductor with a relatively high conductivity may be obtained based on these aluminium alloys. This relatively high conductivity may for example be equal or higher than that of hard pure aluminium (61% IACS), up to the conductivity of soft pure aluminium (63% IACS); depending on the specific composition of the alloy and the specific thermal treatment that were selected. When reference is made to pure aluminium, reference is made to technically pure aluminium with at least 99.7% aluminium. This may be advantageously used in the preparation of various soft or hard aluminium conductors with improved characteristics, i.e. with a higher conductivity, tensile strength and/or thermal resistance compared with known aluminium conductors. Furthermore, in certain embodiments, the improvement of one or several of these characteristics may be advantageously obtained without sacrificing the other characteristics, again compared with already known aluminium conductors.

In embodiments, the aluminium alloy may comprise 99.5% (m/m) or more aluminium, preferably 99.65% (m/m) or more. A higher mass fraction of aluminium typically advantageously leads to a conductor with a higher conductivity.

In embodiments, the aluminium alloy may furthermore also comprise 0.00 to 0.02% (m/m) yttrium and/or erbium, preferably 0.01% (m/m). A small mass fraction of yttrium and/or erbium typically advantageously leads to a conductor with a higher thermal resistance. In embodiments of the present invention, yttrium and/or erbium may both be used as single element, in combination with each other or in combination with one or several elements of groups III, IV and V from Mendeljev's table.

In embodiments, the aluminium alloy may furthermore also comprise 0.1 to 0.3% (m/m) iron, preferably 0.12 to 0.18% (m/m). A small mass fraction of iron typically advantageously leads to a higher tensile strength and recrystallisation temperature, with only a minor influence on the conductivity.

In embodiments, the thermal treatment may for example comprise a treatment at a temperature of 185 to 315° C. for 12 to 24 hours. Depending on the temperature chosen, a soft or a hard conductor may be advantageously obtained; a soft conductor typically has a higher conductivity but a lower tensile strength than a hard conductor. The duration of this thermal treatment, up to 24 hours, is advantageously considerably shorter than typically necessary for known hard aluminium conductors with a high thermal resistance, where the thermal treatment may for example reach up to 6 days.

In embodiments,

- the group 3 elements may be scandium or yttrium or a combination thereof,
- the group 4 elements may be titanium, zirconium or hafnium or a combination thereof,
- the group 5 elements may be niobium or tantalum or a combination thereof, and
- the lanthanide may be lanthanum, cerium, praseodymium or erbium or a combination thereof.

In embodiments, this conductor may have a cross section with a rather oval shape, such as circular (FIG. 1.*a*). In other embodiments, this conductor may have a cross section with a more angular shape, such as rather trapezoidal (FIG. 1.*b*). A more angular diameter may advantageously lead to a cable with a better space filling.

In table 1 below, some preferable embodiments of the aluminium conductors according to the present invention are compared with known aluminium conductors.

In a first preferable embodiment, the aluminium alloy may comprise 0.008 to 0.010% (m/m) zirconium, and the thermal treatment may comprise a treatment at a temperature of 270 to 290° C. for 12 to 24 hours. Furthermore, the aluminium alloy may also comprise 0.00 to 0.02% (m/m) yttrium and/or erbium, such as 0.01% (m/m) yttrium, and 0.1 to 0.3% (m/m) iron, such as 0.12 to 0.18% (m/m). In this manner, soft aluminium conductors may be advantageously obtained with a considerably higher tensile strength compared with pure soft aluminium conductors (+/−50% higher), with a same conductivity (63%) and a higher thermal resistance (180/220). These conductors may for example be advantageously used in high-voltage cables of the 'aluminium conductors composite core (ACCC™)' or 'aluminium conductors steel supported (ACSS)' type, where, in both cases, the tensile strength of the cable, and therefore the resistance versus deflection under load, is increased by the higher tensile strength of the soft aluminium conductor.

In a second preferable embodiment, the aluminium alloy may comprise 0.013 to 0.020% (m/m) zirconium, and the thermal treatment may comprise a treatment at a temperature of 185 to 225° C. for 12 to 24 hours. Furthermore, the aluminium alloy may also comprise 0.00 to 0.02% (m/m) yttrium and/or erbium, such as 0.01% (m/m) yttrium, and 0.1 to 0.3% (m/m) iron, such as 0.12 to 0.18% (m/m). In this manner, hard aluminium conductors may be advantageously obtained with characteristics corresponding with AT1 AlZr conductors, however with a higher conductivity (61.5% vs 60%). These conductors may for example be advantageously used in high-voltage cables of the ACCC' type, where the tensile strength of the cable is further increased, more so than is the case for the aluminium conductors mentioned earlier of the first preferable embodiment, at the expense of a reduction in the conductivity (61.5% vs 63%). On the other hand, these conductors may for example also be advantageously used in high-voltage cables of the 'aluminium conductor steel reinforced (ACSR)' type, where the thermal resistance and the conductivity of the cable are increased compared with pure hard aluminium.

TABLE 1

| | | | Pure | | |
|---|---|---|---|---|---|
| | | | 1 | 2 | 3 |
| | | | The present invention | | |
| | Type of conductor | | | | |
| | Soft | Hard | Soft | Hard | Hard |
| Chemical composition (in % (m/m)) | | | | | |
| Zr | — | — | 0.008-0.010 | 0.013-0.020 | 0.020-0.025 |
| Y | — | — | 0.01 | 0.01 | 0.01 |
| Fe | — | — | 0.12-0.18 | 0.12-0.18 | 0.12-0.18 |
| Mg | — | — | — | — | — |
| Si | — | — | — | — | — |
| Thermal treatment | | | | | |
| On | Wire | | Wire | Wire | Wire |
| Temp 1 | 420° C. | NONE | 280 +/− 10 | 205 +/− 20 | 220 +/− 20 |
| Time 1 | 15 | — | 18 +/− 6 | 18 +/− 6 | 18 +/− 6 |
| Temp 2 | — | — | — | — | — |
| Time 2 | — | — | — | — | — |

TABLE 1-continued

| | | | Pure | | |
|---|---|---|---|---|---|
| | | | 1 | 2 | 3 |
| | | | The present invention | | |
| | Type of conductor | | | | |
| | Soft | Hard | Soft | Hard | Hard |
| Thermal resistance (in ° C.) | | | | | |
| 1 hour | | 150 | 255 | 230 | 255 |
| 400 hours | | 120 | 220 | 180 | 220 |
| 40 years | | 80 | 180 | 150 | 180 |
| Tensile strength (in MPa) | | | | | |
| — to 2.6 mm | 60- | 170 | 90 | 169 | 169 |
| 2.6-2.9 mm | 60- | 170 | 90 | 166 | 166 |
| 2.9-3.5 mm | 60- | 165 | 90 | 162 | 162 |
| 3.5-3.8 mm | 60- | 160 | 90 | 162 | 162 |
| 3.8-4.0 mm | 60- | 160- | 90 | 159 | 159 |
| 4.0-4.5 mm | 60- | 160- | 90 | 159 | 159 |
| Conductivity (in % IACS) | | | | | |
| | 63.00 | 61.00 | 63.00 | 61.50 | 61.00 |
| Extend (in % | | | | | |
| | | | >15% | >2.5% | >2.5% |

In a third preferable embodiment, the aluminium alloy may comprise 0.020 to 0.025% (m/m) zirconium, and the thermal treatment may comprise a treatment at a temperature of 200 to 240° C. for 12 to 24 hours. Furthermore, the aluminium alloy may also comprise 0.00 to 0.02% (m/m) yttrium and/or erbium, such as 0.01% (m/m) yttrium, and 0.1 to 0.3% (m/m) iron, such as 0.12 to 0.18% (m/m). In this manner, hard aluminium conductors may be advantageously obtained with the same conductivity as pure hard aluminium (61%) but with a higher temperature resistance. Alternatively, these conductors may also be compared with the current aluminium alloys with high thermal resistance, where the conductors according to this third preferable embodiment have a thermal resistance between that of AT1 and AT3 AlZr conductors (180/220 vs 150/180 and 210/240) but with a higher conductivity (61% vs 60%). These conductors may for example again be advantageously used in high-voltage cables of the ACCC' type, where the tensile strength of the cable is further increased, again more so than is the case for the aluminium conductors mentioned earlier of the first preferable embodiment, at the expense of a reduction in the conductivity (61% vs 63%). On the other hand, these conductors may for example also again be advantageously used in high-voltage cables of the ACSR type, where the thermal resistance is further increased, more so than is the case for the aluminium conductors mentioned earlier of the second preferable embodiment the conductivity, and the same conductivity as pure hard aluminium. The latter too may be an advantage in practice as it allows for exchanging existing pure hard aluminium conductors for aluminium conductors according to the present invention, without adjustments to the rest of the system.

It should be noted that tolerances in temperatures may further depend on composition, trace elements and for example variations in the type of oven. The person skilled in the art may, where necessary, bring a more specific characterisation, depending on local variations such as the temperature process, the packaging, the diameters of the wire, the exact composition, etc. into account.

In a second aspect, the present invention relates to a use of the conductor from the first aspect in a high-voltage cable. In embodiments, the conductor may correspond with embodiments of the first aspect.

In a third aspect, the present invention relates to a high-voltage cable (1) comprising a core (2) and one or several conductors (3) according to the first aspect. A schematic representation of such a cable is shown in FIGS. 1(*a*) to 1(*c*). In embodiments, the conductor may correspond with embodiments of the first aspect.

In embodiments, the core may comprise composite, steel, or invar.

In embodiments, the core may comprise composite or steel, the aluminium alloy may comprise 0.008 to 0.010% (m/m) zirconium, and the thermal treatment may for example comprise a treatment at a temperature of 270 to 290° C. for 12 to 24 hours.

In embodiments, the core may comprise composite or steel, the aluminium alloy may comprise 0.013 to 0.020% (m/m) zirconium, and the thermal treatment may comprise a treatment at a temperature of 185 to 225° C. for 12 to 24 hours.

In embodiments, the core may comprise composite or steel, the aluminium alloy may comprise 0.020 to 0.025% (m/m) zirconium, and the thermal treatment may comprise a treatment at a temperature of 200 to 240° C. for 12 to 24 hours.

In a fourth aspect, the present invention relates to an aluminium alloy suitable for use in the conductor according to the first aspect, which comprises one or several of a group 3, 4 or 5 element and/or a lanthanide, each with a concentration in the range of 0.006 to 0.03% (m/m), preferably in a range of 0.006 to 0.027% (m/m) such as for example in the range of 0.008 to 0.025% (m/m).

In embodiments, the aluminium alloy may comprise 99.5% (m/m) or more aluminium, preferably 99.65% (m/m) or more.

In embodiments, the aluminium alloy may furthermore also comprise 0.00 to 0.02% (m/m) yttrium or erbium, preferably 0.01% (m/m).

In embodiments, the aluminium alloy may furthermore also comprise 0.1 to 0.3% (m/m) iron, preferably 0.12 to 0.18% (m/m).

In embodiments, the aluminium alloy may be fully annealed.

In embodiments, the group 3 elements may be scandium or yttrium or a combination thereof, the group 4 elements may be titanium, zirconium or hafnium or a combination thereof, the group 5 elements may be niobium or tantalum or a combination thereof, and the lanthanide may be lanthanum, cerium, praseodymium or erbium or a combination thereof.

In a fifth aspect, the present invention relates to a use of the aluminium alloys according to the fourth aspect in the conductor according to the first aspect. In embodiments, the aluminium may correspond with embodiments of the fourth aspect.

In a further aspect, the present invention relates to a method for the production of a conductor suitable for use in a high-voltage cable. The method includes melting of technically pure aluminium in a melting furnace, alloying of the alloy elements, continuously casting of a profile, rolling of the profile within a temperature range of 380° C. to 540° C., drawing of wires from a wire rod to the end diameter and thermal treating of the wires with end diameter. The method may furthermore yet also include a final deformation step, carried out on a drawing machine or in a cable machine. The method may furthermore also include stranding of the wires in a cabling machine for bare conductors.

It is an advantage of embodiments of the present invention that the thermal treatment which determines the characteristics in respect of conductivity and tensile strength is carried out on the wires with the end diameter and not on the wire rod. This results in a conductor that combines the unique characteristics of a good conductivity, a good tensile strength, and a good thermal resistance.

According to embodiments of the present invention, alloying of the alloy elements includes adding of alloy elements so that the composition corresponds with these as indicated for the conductors as described in the aspect mentioned above.

In some embodiments, rolling of the profile may happen in a temperature range between 420° C. and 520° C., for example in a temperature range between 440° C. and 500° C.

In some embodiments of the present invention, the method also includes cooling of the profile in the roller to a temperature in the range of 80° C. to 330° C., for example to a temperature in the range of 250° C. to 320° C. or to a temperature in the range of 80° C. to 160° C. or to a temperature in the range of 150° C. to 250° C. It is an advantage of some embodiments of the present invention that the tensile strength may be high, particularly when the temperature is lower when removing the profile from the roller.

In some embodiments, the roller diameters are in a range of 8 mm to 25 mm, for example in a range of 9.5 mm to 18 mm, such as for example in a range of 9.5 mm to 12 mm.

In some embodiments, the end diameters of the wires, or the equivalent end diameters—i.e. average diameter—if the wires are not round but of another shape in respect of their profile shape, are in the range of 1 mm to 7 mm, for example in the range of 2 mm to 5 mm.

In some embodiments, the thermal treatment on the wires has been drawn on their end diameter, a thermal treatment in batch or in-line. It should be noted that the thermal treatment of the drawn conductor when it is on its end diameter allows for the specifically good characteristics of the conductor to be obtained, without any further thermal treatments being required, such as homogenisation of an ingot, annealing or ageing.

Specific and preferable aspects of the invention have been included in the attached independent and dependent claims. Features of the dependent claims may be combined with features of the independent claims and with features of other dependent claims such as indicated and not only as expressly brought forward in the claims.

These and other aspects of the invention will be apparent from and be clarified by reference to the embodiment(s) described below.

The various aspects can easily be combined, and the combinations will also correspond with embodiments according to the present invention.

By way of illustration, embodiments not limited as a result, further examples of alloys according to examples of the present invention are given in tables 2 to 4 below.

TABLE 2

| | | | Pure | | | |
|---|---|---|---|---|---|---|
| | | | 1 | 2 | 3 | 4 |
| | | | The present invention | | | |
| | Type of conductor | | | | | |
| | Soft | Hard | Soft | Soft | Hard | Hard |
| | Chemical composition (in %(m/m)) | | | | | |
| Sc | — | — | 0.005-0.010 | 0.027 | 0.005- | 0.027 |
| Y and/or Er | — | — | 0.01 | 0.01 | 0.01 | 0.01 |
| Fe | — | — | 0.12-0.18 | 0.12-0.18 | 0.12-0.18 | 0.12-0.18 |
| Mg | — | — | — | — | — | — |
| Si | — | — | — | — | — | — |
| | Thermal treatment | | | | | |
| On | Wire | | Wire | Wire | Wire | Wire |
| Temp 1 (in ° C.) | 420° C. | NONE | 280 +/− 10 | 280 +/− 10 | 220 +/− 20 | 220 +/− 20 |
| Time 1 (in hrs) | 15 | — | 18 +/− 6 | 18 +/− 6 | 18 +/− 6 | 18 +/− 6 |

TABLE 2-continued

| | | | Pure | | | |
|---|---|---|---|---|---|---|
| | | | 1 | 2 | 3 | 4 |
| | | | The present invention | | | |
| | Type of conductor | | | | | |
| | Soft | Hard | Soft | Soft | Hard | Hard |
| Temp 2 (in ° C.) | — | — | — | — | | — |
| Time 2 (in hrs) | — | — | — | — | | — |
| | Thermal resistance (in ° C.) | | | | | |
| 1 hour | | 150 | 255 | 255 | 230 | 280 |
| 400 hours | | 120 | 220 | 220 | 180 | 240 |
| 40 years | | 80 | 180 | 180 | 150 | 210 |
| | Tensile strength (in MPa) | | | | | |
| — to 2.6 mm | 60- | 170 | 90 | 125 | 169 | 169 |
| 2.6-2.9 mm | 60- | 170 | 90 | 125 | 166 | 166 |
| 2.9-3.5 mm | 60- | 165 | 90 | 125 | 162 | 162 |
| 3.5-3.8 mm | 60- | 160 | 90 | 125 | 162 | 162 |
| 3.8-4.0 mm | 60- | 160- | 90 | 125 | 159 | 159 |
| 4.0-4.5 mm | 60- | 160- | 90 | 125 | 159 | 159 |
| | Conductivity (in % IACS) | | | | | |
| | 63.0 | 61.00 | 63.00 | 62.0 | 62.0 | 61.00 |
| | Extension | | | | | |
| | >30 | 1-2% | >50% | >8% | >2.5% | >2.5% |

TABLE 3

| | | | Pure | | | |
|---|---|---|---|---|---|---|
| | | | 1 | 2 | 3 | 4 |
| | | | The present invention | | | |
| | Type of conductor | | | | | |
| | Soft | Hard | Soft | Soft | Hard | Hard |
| | Chemical composition (in %(m/m)) | | | | | |
| Er | — | — | 0.025 | 0.01 | 0.025 | 0.01 |
| Y | — | — | 0.01 | 0.025 | 0.01 | 0.025 |
| Fe | — | — | 0.12-0.18 | 0.12-0.18 | 0.12-0.18 | 0.12-0.18 |
| Mg | — | — | — | — | — | — |
| Si | — | — | — | — | — | — |
| | Thermal treatment | | | | | |
| On | Wire | | Wire | Wire | Wire | Wire |
| Temp 1 (in ° C.) | 420° C. | NONE | 280 +/− 10 | 280 +/− 10 | 220 +/− 20 | 220 +/− 20 |
| Time 1 (in hrs) | 15 | — | 18 +/− 6 | 18 +/− 6 | 18 +/− 6 | 18 +/− 6 |
| Temp 2 (in ° C.) | — | — | — | — | | — |
| Time 2 (in hrs) | — | — | — | — | | — |
| | Thermal resistance (in ° C.) | | | | | |
| 1 hour | | 150 | 255 | 255 | 230 | 230 |
| 400 hours | | 120 | 220 | 220 | 180 | 180 |
| 40 years | | 80 | 180 | 180 | 150 | 150 |
| | Tensile strength (in MPa) | | | | | |
| — to 2.6 mm | 60- | 170 | 90 | 90 | 169 | 169 |
| 2.6-2.9 mm | 60- | 170 | 90 | 90 | 166 | 166 |
| 2.9-3.5 mm | 60- | 165 | 90 | 90 | 162 | 162 |

TABLE 3-continued

| | | | Pure | | | |
|---|---|---|---|---|---|---|
| | | | 1 | 2 | 3 | 4 |
| | | | The present invention | | | |
| | Type of conductor | | | | | |
| | Soft | Hard | Soft | Soft | Hard | Hard |
| 3.5-3.8 mm | 60- | 160 | 90 | 90 | 162 | 162 |
| 3.8-4.0 mm | 60- | 160- | 90 | 90 | 159 | 159 |
| 4.0-4.5 mm | 60- | 160- | 90 | 90 | 159 | 159 |
| | Conductivity (in % IACS) | | | | | |
| | 63.00 | 61.00 | 63.00 | 63.0 | 61.50 | 61.50 |
| | Extension | | | | | |
| | >30% | 1-2% | >15% | >15% | >2.5% | >2.5% |

TABLE 4

| | | | Pure | | |
|---|---|---|---|---|---|
| | | | 1 | 2 | 3 |
| | | | The present invention | | |
| | Type of conductor | | | | |
| | Soft | Hard | Soft | Hard | Hard |
| | Chemical composition (in % (m/m)) | | | | |
| Hf | — | — | 0.008-0.010 | 0.013-0.020 | 0.020-0.025 |
| Y or Er | — | — | 0.01 | 0.01 | 0.01 |
| Fe | — | — | 0.12-0.18 | 0.12-0.18 | 0.12-0.18 |
| Mg | — | — | — | — | — |
| Si | — | — | — | — | — |
| | Thermal treatment | | | | |
| On | Wire | | Wire | Wire | Wire |
| Temp 1 (in ° C.) | 420° C. | NONE | 280 +/− 10 | 205 +/− 20 | 220 +/− 20 |
| Time 1 (in hrs) | 15 | — | 18 +/− 6 | 18 +/− 6 | 18 +/− 6 |
| Temp 2 (in ° C.) | — | — | — | — | — |
| Time 2 (in hrs) | — | — | — | — | — |
| | Thermal resistance (in ° C.) | | | | |
| 1 hour | | 150 | 255 | 230 | 255 |
| 400 hours | | 120 | 220 | 180 | 220 |
| 40 years | | 80 | 180 | 150 | 180 |
| | Tensile strength (in MPa) | | | | |
| — to 2.6 mm | 60-65 | 170 | 90 | 169 | 169 |
| 2.6-2.9 mm | 60-65 | 170 | 90 | 166 | 166 |
| 2.9-3.5 mm | 60-65 | 165 | 90 | 162 | 162 |
| 3.5-3.8 mm | 60-65 | 160 | 90 | 162 | 162 |
| 3.8-4.0 mm | 60-65 | 160- | 90 | 159 | 159 |
| 4.0-4.5 mm | 60-65 | 160- | 90 | 159 | 159 |
| | Conductivity (in % IACS) | | | | |
| | 63.00 | 61.00 | 63.00 | 62.00 | 61.50 |
| | Extension | | | | |
| | >30% | 1-2% | >15% | >2.5% | >2.5% |

The invention claimed is:

1. An overhead high-voltage line comprising a conductor, the conductor being formed as a wire or a plurality of wires drawn from wire rod, wherein the conductor includes an aluminium alloy, wherein the aluminium alloy includes one or several of a group 3, 4 or 5 element and optionally a lanthanide, each with a concentration in the range 0.006 to 0.030% (m/m), wherein the conductor has undergone a thermal treatment in the form of the drawn wire or wires at a temperature from within the range 185° C. to 315° C. for a period from within the range 12 hours to 24 hours, wherein the conductor has undergone the thermal treatment before any cabling or stranding of the wire or wires to form the overhead high-voltage line, and wherein the conductor has a conductivity of 61% IACS or more.

2. The overhead high-voltage line according to claim 1, in which the aluminium alloy comprises 99.5%(m/m) or more aluminium.

3. The overhead high-voltage line according to claim 1, in which the aluminium alloy comprises 0.00 to 0.02%(m/m) yttrium and/or erbium.

4. The overhead high-voltage line according to claim 1, in which the aluminium alloy furthermore also comprises 0.1 to 0.3%(m/m) iron.

5. The overhead high-voltage line according to claim 1 in which:

the group 3 element is scandium or yttrium or a combination thereof, the group 4 element is titanium, zirconium or hafnium or a combination thereof, the group 5 element is niobium or tantalum or a combination thereof, and the lanthanide is lanthanum, cerium, praseodymium or erbium or a combination thereof.

6. The overhead high-voltage line according to claim 1, in which the aluminium alloy comprises 0.008 to 0.010% (m/m) zirconium, and in which the thermal treatment comprises a treatment at a temperature of 270 to 290° C. for 12 to 24 hours.

7. The overhead high-voltage line according to claim 1, in which the aluminium alloy comprises 0.013 to 0.020% (m/m) zirconium, and in which the thermal treatment comprises a treatment at a temperature of 185 to 225° C. for 12 to 24 hours.

8. The overhead high-voltage line according to claim 1, in which the aluminium alloy comprises 0.020 to 0.025% (m/m) zirconium, and in which the thermal treatment comprises a treatment at a temperature of 200 to 240° C. for 12 to 24 hours.

9. The overhead high-voltage according to claim 1, further comprising a core and one or several conductors.

10. The overhead high-voltage line according to claim 9, in which the core comprises composite or steel or invar.

11. A method for the production of the high-voltage line according to claim 1, the method including the production of a conductor by melting of technically pure aluminium in a melting furnace, alloying of the alloy elements, continuously casting of a profile and in-line rolling of the profile within a temperature range of 380° C. to 540° C., drawing of the conductor from the wire rod to the end diameter, and performing the thermal treatment of the wires with the end diameter.

12. An overhead high-voltage line comprising a conductor, the conductor being formed as a wire or a plurality of wires drawn from wire rod, wherein the conductor includes an aluminium alloy, wherein the aluminium alloy includes one or several of a group 3, 4 or 5 element, each with a concentration in the range 0.006 to 0.030%(m/m), wherein the conductor has undergone a thermal treatment in the form of the drawn wire or wires at a temperature from within the range 185° C. to 315° C. for a period from within the range 12 hours to 24 hours, wherein the conductor has undergone the thermal treatment before any cabling or stranding of the wire or wires to form the overhead high-voltage line, and wherein the conductor has a conductivity of 61% IACS or more.

13. The overhead high-voltage line according to claim 12, in which the aluminium alloy comprises a lanthanide with a concentration in the range 0.006 to 0.030%(m/m).

14. An overhead high-voltage line comprising a conductor, the conductor being formed as a wire or a plurality of wires drawn from wire rod, wherein the conductor includes an aluminium alloy, wherein the aluminium alloy comprises one or several of a group 3, 4 or 5 element with a concentration in the range 0.006 to 0.030%(m/m), wherein the aluminium alloy optionally comprises a lanthanide with a concentration in the range 0.006 to 0.030%(m/m), and wherein, before any cabling or stranding of the wire or wires to form the overhead high-voltage line, the conductor has a conductivity of 61% IACS or more.

* * * * *